US005819397A

United States Patent [19]

Knight et al.

[11] Patent Number: 5,819,397

[45] Date of Patent: Oct. 13, 1998

[54] METHOD FOR ASSEMBLING A THREE-PHASE CURRENT TRANSFORMER

[75] Inventors: Michael W. Knight, Fuquay-Varina; Greg Lawrence, Wilson; Gregory Link, Cary; James T. Tucker, Knightdale, all of N.C.

[73] Assignee: Square D Company, Palatine, Ill.

[21] Appl. No.: 707,938

[22] Filed: Sep. 10, 1996

[51] Int. Cl.[6] ..... H01F 27/20; H01F 41/02

[52] U.S. Cl. ..... 29/605; 29/606; 29/609; 242/46.21; 336/92; 336/210

[58] Field of Search ..... 29/602.1, 605, 29/606, 609; 242/46.21, 439, 440.1, 441; 336/65, 92, 178, 198, 210

[56] References Cited

U.S. PATENT DOCUMENTS 4,603,314 7/1986 Fukunaga et al. ..... 29/605 X 4,890,086 12/1989 Hill ..... 29/606 X 5,699,977 12/1997 Watanabe ..... 29/605

*Primary Examiner*—W. Donald Bray

*Attorney, Agent, or Firm*—Larry I. Golden; David R. Stacey; Larry T. Shrout

[57] ABSTRACT

A method of assembling a three phase current transformer for printed circuit board installation. Three current transformers, each having a spin wound coil positioned about one leg of an unassembled continuous lamination core, are placed side-by-side in a transformer carrier such that two parallel core legs of the center transformer overlap the adjacent core legs of the two outside transformers and further such that printed circuit board terminal pins attached to the coils pass through stand-off sleeves formed from the transformer carrier. Rivets are placed through holes in the laminations of the overlapped core legs and in the transformer carrier thereby simultaneously riveting the three transformer cores and the transformer carrier together making a three phase transformer assembly.

3 Claims, 7 Drawing Sheets

METHOD FOR ASSEMBLING A THREE-PHASE CURRENT TRANSFORMER

FIELD OF THE INVENTION

The present invention relates to the field of current transformers and particularly to a method for making and assembling a three phase current transformer for installation on a printed circuit board.

BACKGROUND OF THE INVENTION

It is known in the industry to assemble current transformers for a particular application such as installation on printed circuit boards. For laminated core transformers, this process has included assembly of the two piece C or E-shaped core laminations by staking or riveting, winding the coil, placing the coil on one leg of the core, closing the core by installing an I-bridge which is glued, staked or riveted to the core, mounting the assembled transformer onto a preassembled printed circuit board and soldering the coil terminals to the printed circuit board. For a three phase current transformer the above process is performed three times. As an alternative, three preassembled current transformers can be assembled onto a transformer carrier which is then attached to the preassembled printed circuit board after which all of the transformer coil terminations are soldered to the printed circuit board. These processes involve a number of preassembly procedures or subassemblies which are not cost effective to the end product. It would therefore be desirable to eliminate many of the time consuming preassembly steps and subassemblies to produce a cost effective assembled printed circuit board with current transformers.

SUMMARY OF THE INVENTION

The present invention incorporates a continuous lamination core current transformer with a spin wound coil as described in the concurrently filed Patent Application entitled METHOD FOR HIGH SPEED SPIN WINDING OF A COIL ABOUT A CONTINUOUS LAMINATION CORE Ser. No. 08/711,640, which is incorporated herein by reference. Transformers produced by this method do not require preassembly of the continuous lamination core and have the printed circuit board terminal pins attached prior to winding the coil about the leg of the transformer core. Three transformers produce by this method are placed side-by-side in a transformer carrier such that core legs of the center transformer overlap adjacent core legs of the two outside transformers and the printed circuit board terminal pins are received in stand-off sleeves integrally formed from the transformer carrier. The overlapped core legs and the transformer carrier are simultaneously riveted together thus forming a three phase current transformer assembly. This assembly is then snapped onto a printed circuit board by means integrally formed from the transformer carrier. As the transformer assembly is snapped on to the printed circuit board the printed circuit board terminal pins are received in holes provided in the printed circuit board for electrical connection. Long rivets are inserted through holes in the outside legs of the two outside transformer cores, through stand-off sleeves of the transformer carrier and holes in the printed circuit board. Electrical components, transformer coil printed circuit board terminating pins and the rivets can then be simultaneously wave soldered to the printed circuit board.

Figure 1:
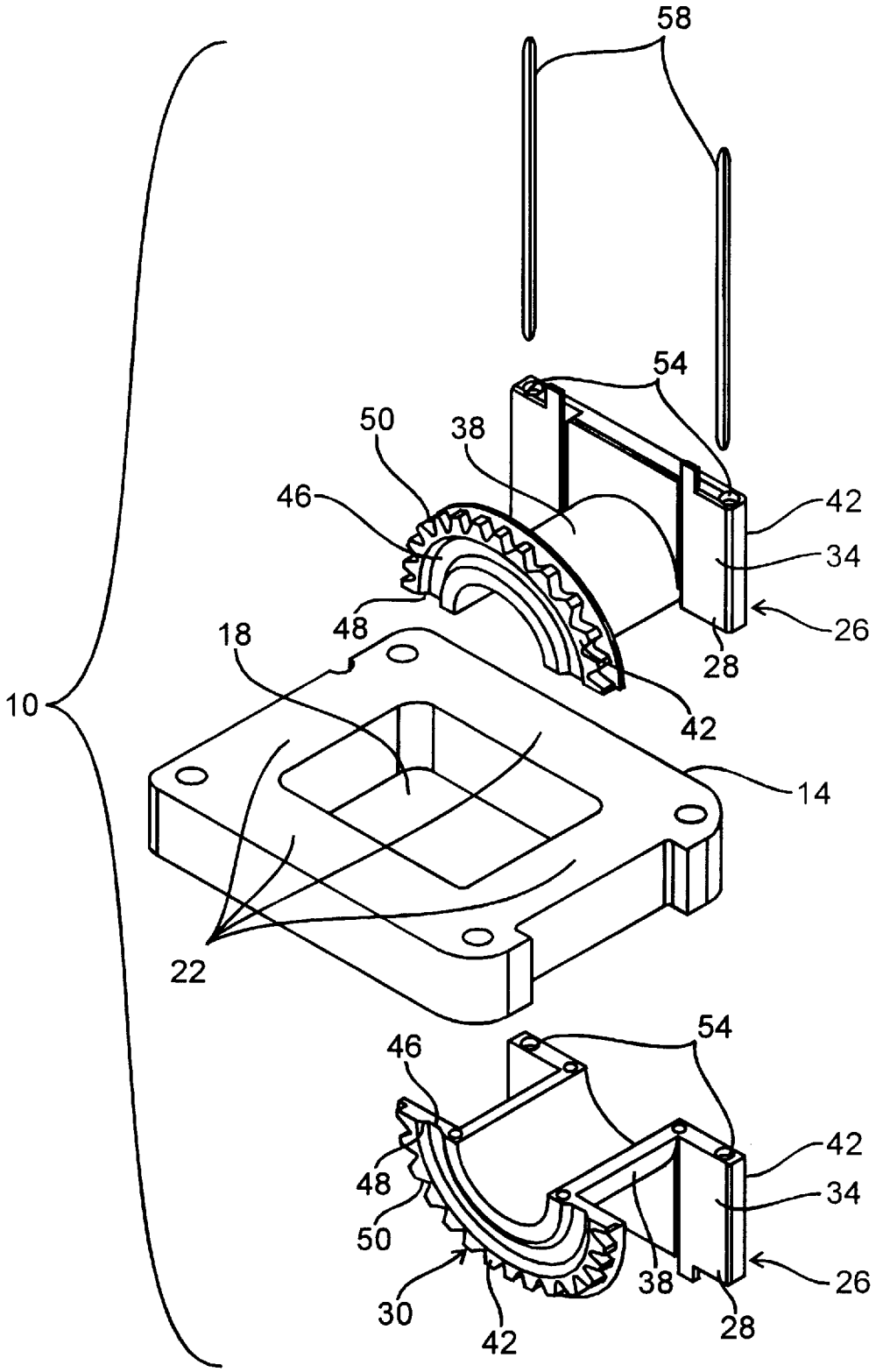
FIG. 1 is an exploded view of a solid or continuous lamination core and a two piece bobbin with printed circuit board terminal pins in accordance with the present invention.

Before one embodiment of the invention is explained in detail, it is to be understood that the invention is not limited in its application to the details of construction and description or illustrated in the drawings. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

Figure 5:
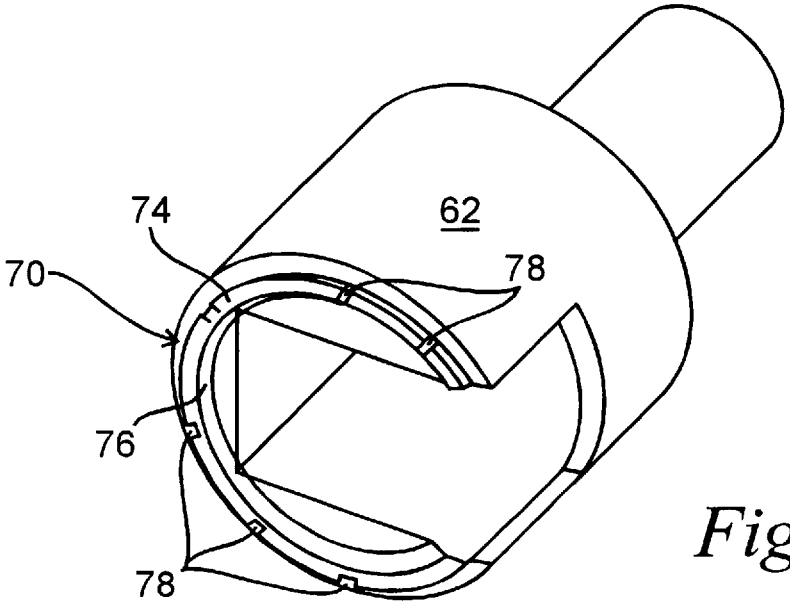
FIG. 5 is an isometric view of the bobbin bearing showing the bearing surface in accordance with the present invention.

FIG. 1 illustrates an exploded view of a continuous lamination core transformer having a high speed spin wound coil in accordance with the present invention and generally indicated by reference numeral 10. The transformer 10 includes a continuous lamination core 14 having a window 18 defined by the integral core legs 22. The core 14 may be generally square or rectangular in shape such that the window 18 defined by the core 14 is also either generally square or rectangular in shape. The transformer 10 also includes a bobbin 26 installed about one of the core legs 22 on which the coil will be wound. The bobbin 26 can be made from two halves 28 which are assembled about one of the legs 22. The bobbin 26 can also be constructed of a single molded piece having an integral hinge joining two similarly shaped halves. In the preferred embodiment the bobbin halves 28 are provided with integrally formed means for being snapped together when installed on the core leg 22. The bobbin 26 includes a first flange 30 which is generally circular in shape and a second flange 34 which is generally square in shape. The first and second flanges, 30 and 34 respectively, extend outwardly from and generally perpendicularly to a generally tubular bobbin base 38 which spaces the two flanges 30 and 34 apart. The tubular bobbin base 38 defines a passage 40 having an inside diameter dimensioned such that the bobbin 26 can rotate freely about the leg 22 of the transformer core 14. Each of the first and second flanges, 30 and 34 respectively, include an outwardly facing surface 42. A concentric groove 46 having a beveled inside surface 48 is defined in each of the outwardly facing surfaces 42. A circumferential gear 50 is also defined in the outwardly facing surface 42 of the first flange 30. The second flange 34 defines two passages 54 being generally parallel to one another and passing through the flange 34 such that a generally equal portion of each passage 54 is defined in each half 28 of the flange 34. Each of the passages 54 is dimensioned to snugly receive a printed circuit board terminal pin 58 which functions as a terminal for the coil wire and an electrical connection to a printed circuit board as shown in FIG. 5. The printed circuit board terminal pins 58 also help to secure the two bobbing halves 28 together during the coil winding process.

The bobbin 26 is installed on the selected core leg 22 by placing one bobbin half 28 on one side of the selected core leg 22 and the other bobbin half 28 on the other side of the selected leg 22 such that flanges 30 and 34 of each half 28 are properly aligned and then snapping the two halves 28 together. When the bobbin halves 28 have been assembled onto the selected core leg 22, the passages 54 in each half of the second flange 34 will be aligned such that two passages 54 pass completely through the assembled second flange 34. Each of the two passages 54 will receive one terminal pin 58 which will pass completely through the second flange 34 as described in detail below.

Figure 2:
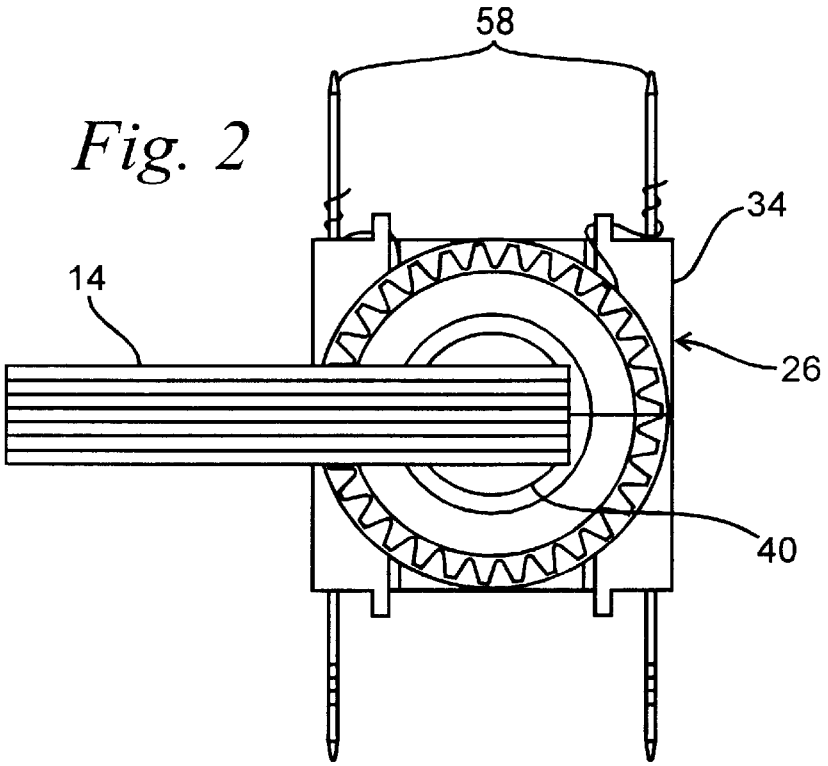
FIG. 2 is a side view of an assembled transformer with printed circuit board terminal pins in the winding position in accordance with the present invention.
Figure 3:
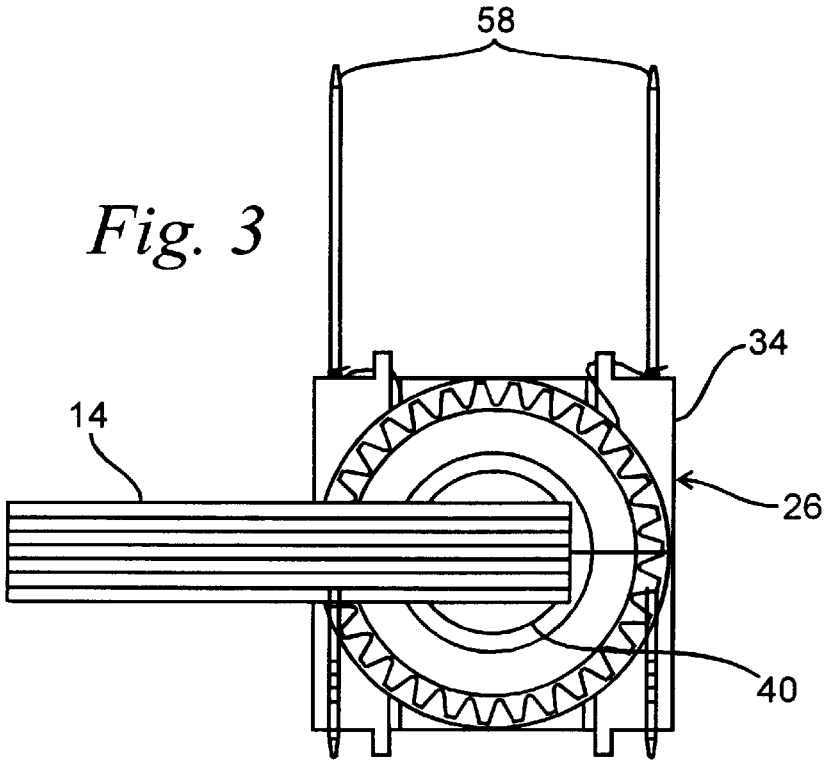
FIG. 3 is a side view of an assembled transformer with printed circuit board terminal pins in the extended printed circuit board mounting position in accordance with the present invention.

The core 14 with attached bobbin 26 is placed into a fixture wherein a printed circuit board terminal pin 58 is supportably pressed into each of the two passages 54. The printed circuit board terminal pins 58 are supported along their length during the insertion process to prevent buckling. When properly inserted, the midpoint of each printed circuit board terminal pin 58 should coincide with the mating line of the two bobbin halves 28 thereby permitting the bobbin 26 with inserted printed circuit board terminal pins 58 to rotate freely about the core leg 22 and within the core window 18, as shown in FIG. 2.

Figure 4:
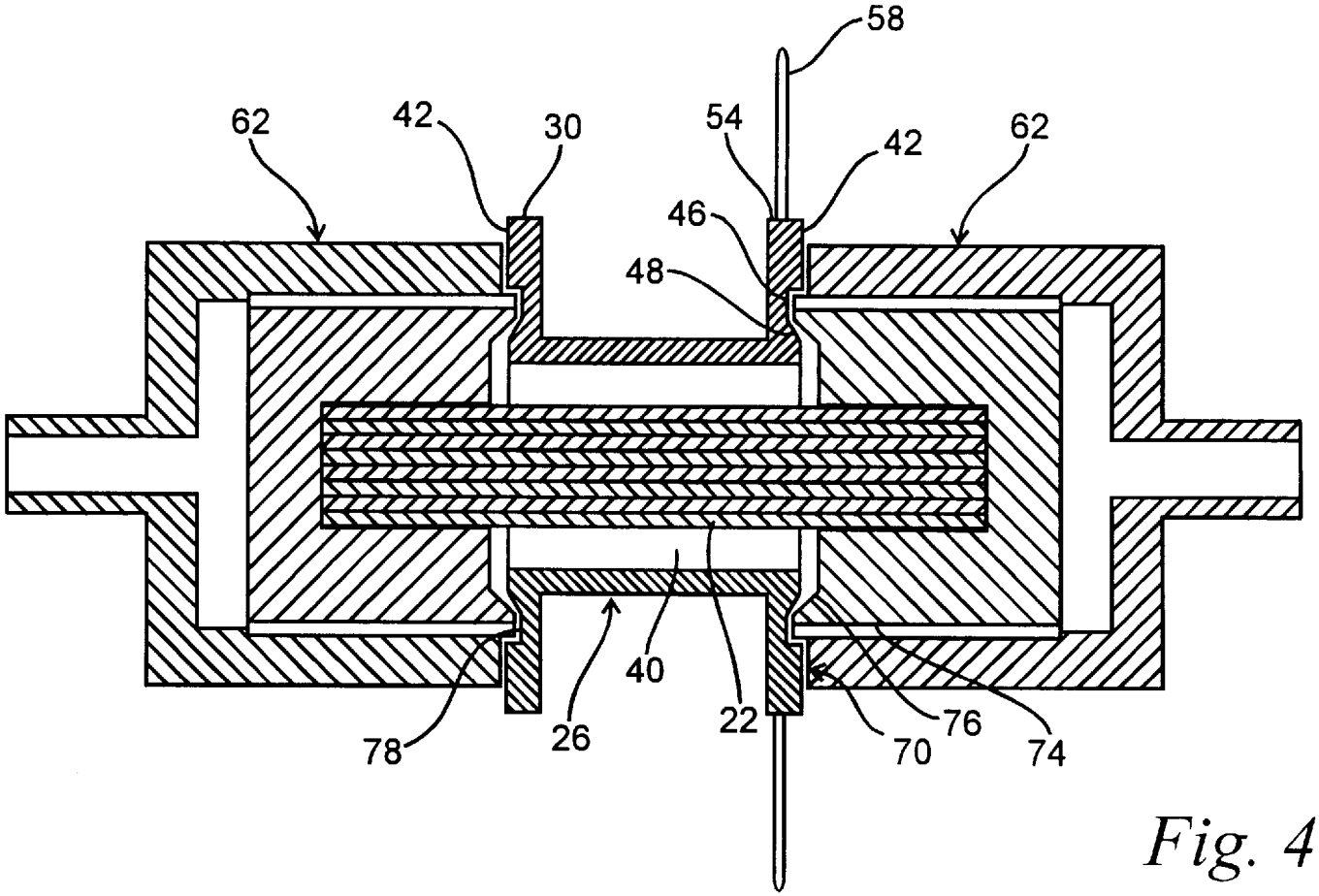
FIG. 4 is a cross-sectional view of a core leg with assembled bobbin and bobbin bearings in place.

The transformer core 14 with coil bobbin 26 installed is placed into a winding fixture which firmly holds the core 14 to prevent movement during the winding process. As shown in FIG. 4, two bobbin bearings 62 are positioned such that one is immediately adjacent each of the outwardly facing surface 42 of each of the two bobbin flanges 30 and 34. As shown in FIG. 5, each of the bobbin bearings 62 have a relief 66 which is dimensioned to slidably receive a portion of the transformer core 14 immediately adjacent the bobbin flanges 30 and 34. The reliefs 66 provide proper positioning of the bearings 62 with respect to the axis of the leg 22 about which the bobbin 26 is to rotate. The relief 66 also assists in holding the unassembled laminations of the core 14 in position during the winding process. Each bearing 62 also includes a bearing surface 70 which has an outwardly extending circumferential ridge 74 with a beveled inside surface 76. The circumferential ridges 74 are formed such that they are complementary to the concentric grooves 46 in the flanges 30 and 34. The beveled inside surfaces 48 of the grooves 46 and the beveled inside surfaces 76 of the ridges 74 assist in centering the bobbin 26 about the core leg 22. Each bearing surface 70 and its circumferential ridge 74 is highly polished to reduce friction between the bearing surfaces 70 and the outwardly facing surfaces 42 of the flanges 30 and 34 during the high speed spin winding process.

When the bobbin bearings 62 are properly positioned the circumferential ridges 74 will be centered about the axis of the core leg 22 and partially received within the concentric grooves 46 of the bobbin flanges 30 and 34. A small gap is maintained between the bearing surfaces 70 of the bobbin bearings 62 and the outwardly facing surfaces 42 of the bobbin flanges 30 and 34. The bearing surfaces 70 are provided with small ports 78 for exhausting low pressure air into the small gap between the bearing surfaces 70 and the outwardly facing surfaces 42 of the bobbin flanges 30 and 34. The flow of low pressure air acts both as a coolant for the bearing surfaces 70 and a cushion between the bearing surfaces 70 and the outwardly facing surfaces 42 of the bobbin flanges 30 and 34 during the high speed spin winding process.

As the coil winding process starts a drive gear engages the circumferential gear 50 on the first flange 30 of the bobbin 26. The bobbin 26 is rotated to an index position wherein the terminal pins 58 are in a known position. Since a fine coil wire is being wound on the bobbin 26 it is preferred that the leading and trailing ends be skeined, i.e. multiple strands of wire are twisted together for additional strength. The skeining is done by a coil wire feeder which also terminates the leading end of the coil wire by wrapping the skeined wire end around one of the printed circuit board terminal pins 58. After terminating the coil wire, the coil wire feeder moves to the starting position over the bobbin base 38 as the drive gear begins rotating the bobbin 26 at a high speed. As the bobbin rotates coil wire is pulled from the coil wire feeder which moves back and forth between the first and second bobbin flanges, 30 and 34 respectively, thereby producing a uniformly wound coil. As the desired number of revolutions is approached the bobbin speed is quickly slowed to a stop within a few revolutions. The wire feeder skeins a portion of the terminating end of the coil wire, wraps the skeined terminating end around the other printed circuit board terminal pin 58, and cuts the wire, leaving enough of the skeined wire to terminate the leading end of the next coil to be wound. The transformer is removed from the winding fixture and the printed circuit board terminal pins 58 are supportably pushed into one side of the bobbin flange 34 such that the desired length of printed circuit board terminal pin 58 extends outward from the opposite side of the second bobbin flange 34. Using this process the time required to assemble the bobbin 26 on the core leg 22 and wind an 8,000 turn fine wire coil on the bobbin is approximately 90 seconds.

Figure 8:
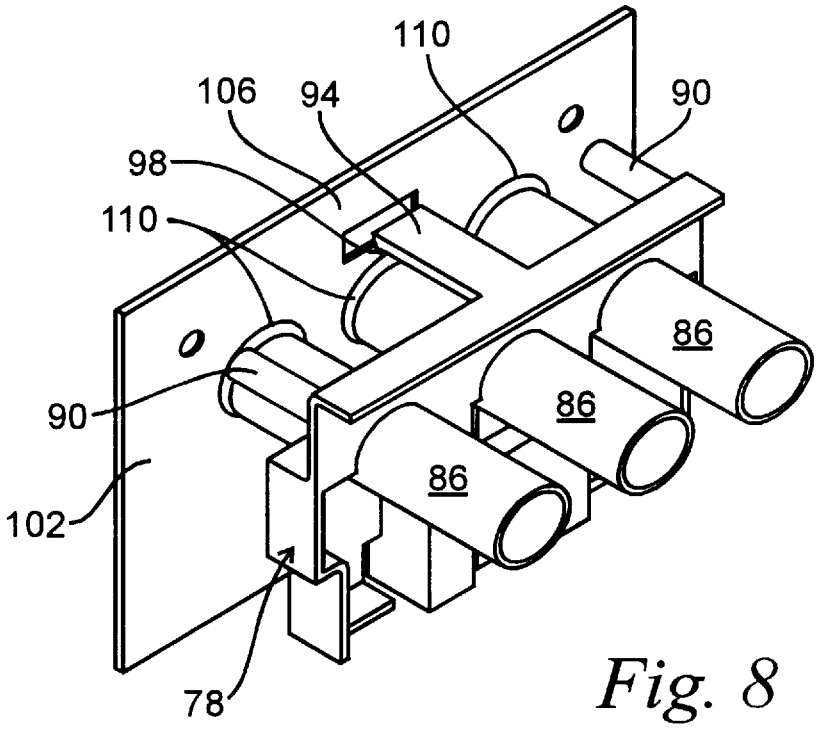
FIG. 8 is an isometric view of a three phase transformer carrier in accordance with the present invention.
Figure 6:
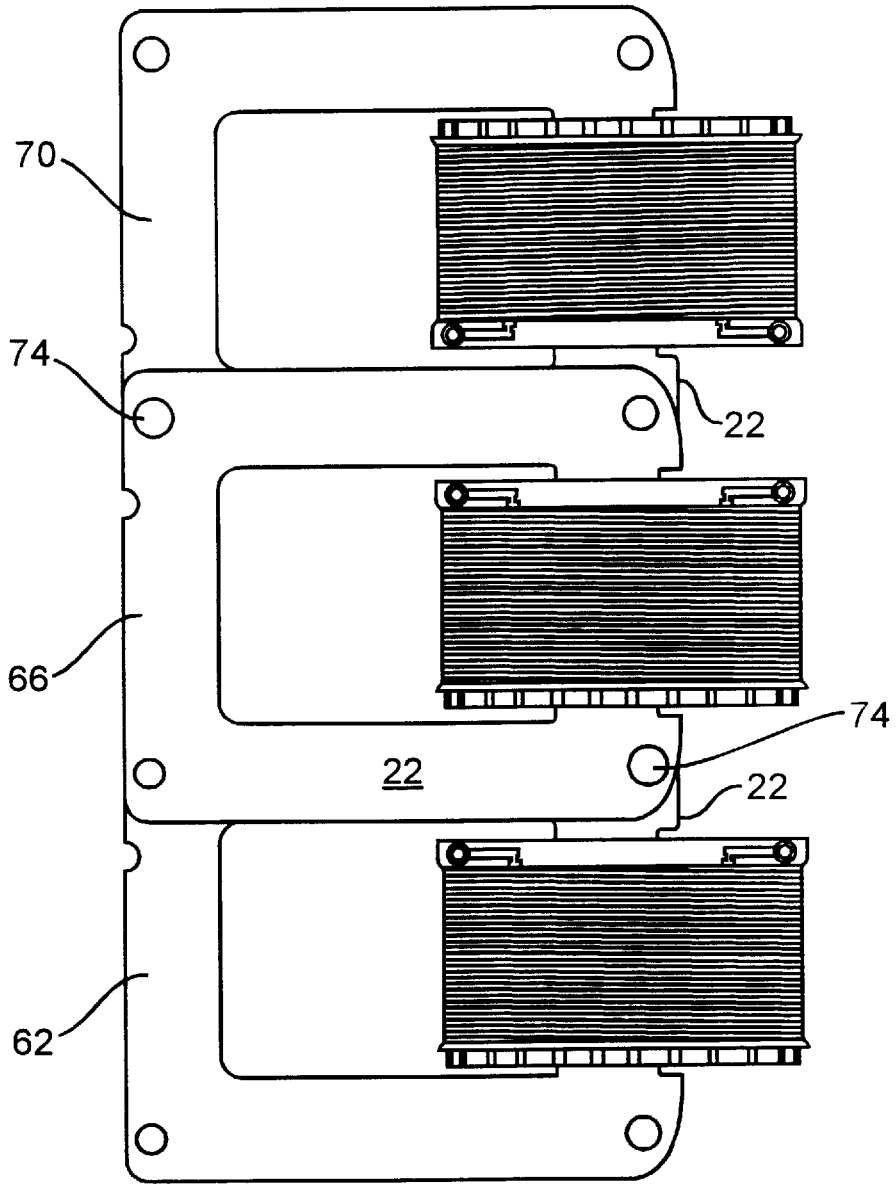
FIG. 6 is a top view of an assembled three phase transformer in accordance with the present invention.
Figure 7:
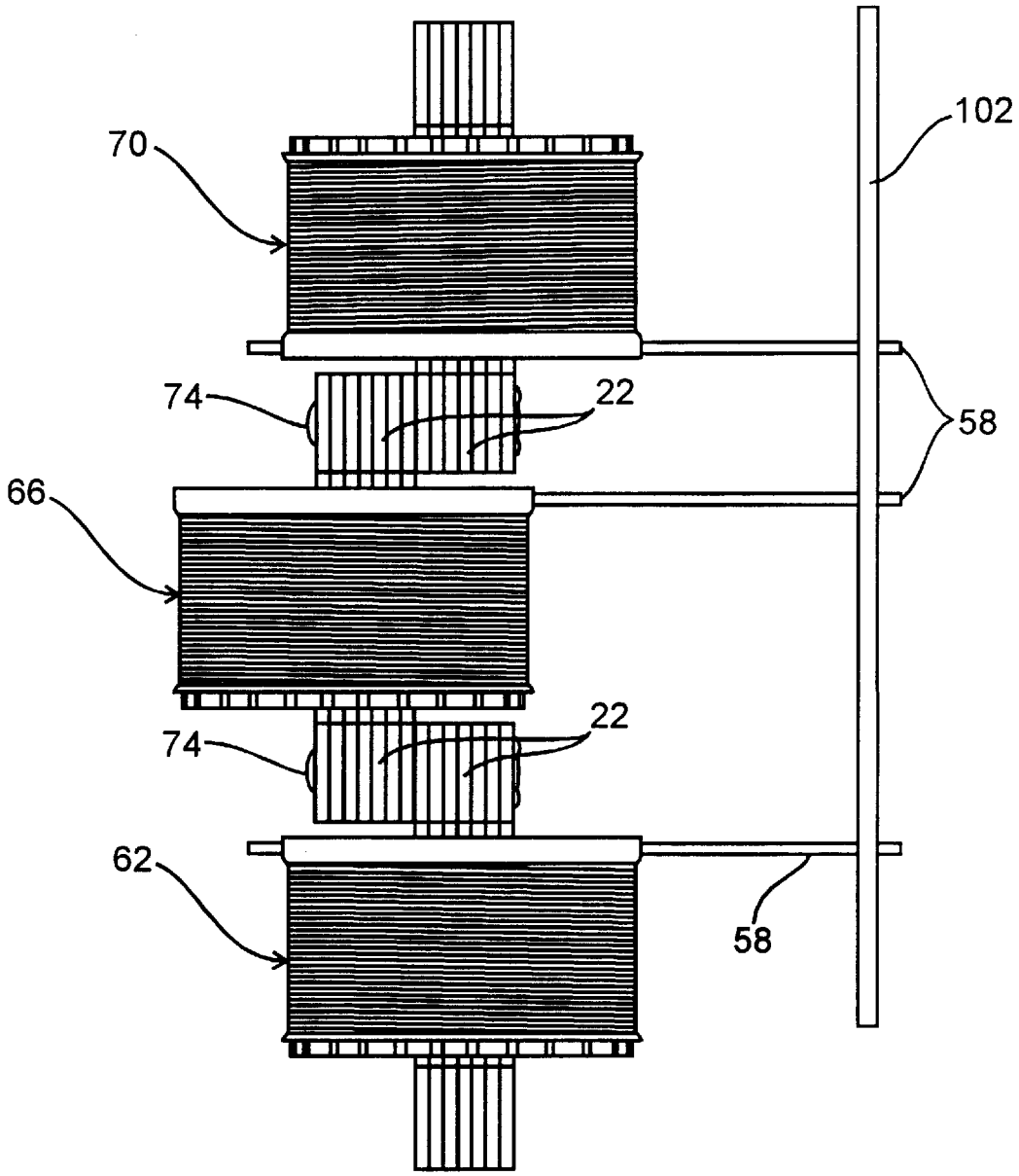
FIG. 7 is a front view of a three phase transformers assembled in accordance with the present invention and electrically connected to a common printed circuit board by printed circuit board terminals.
Figure 9:
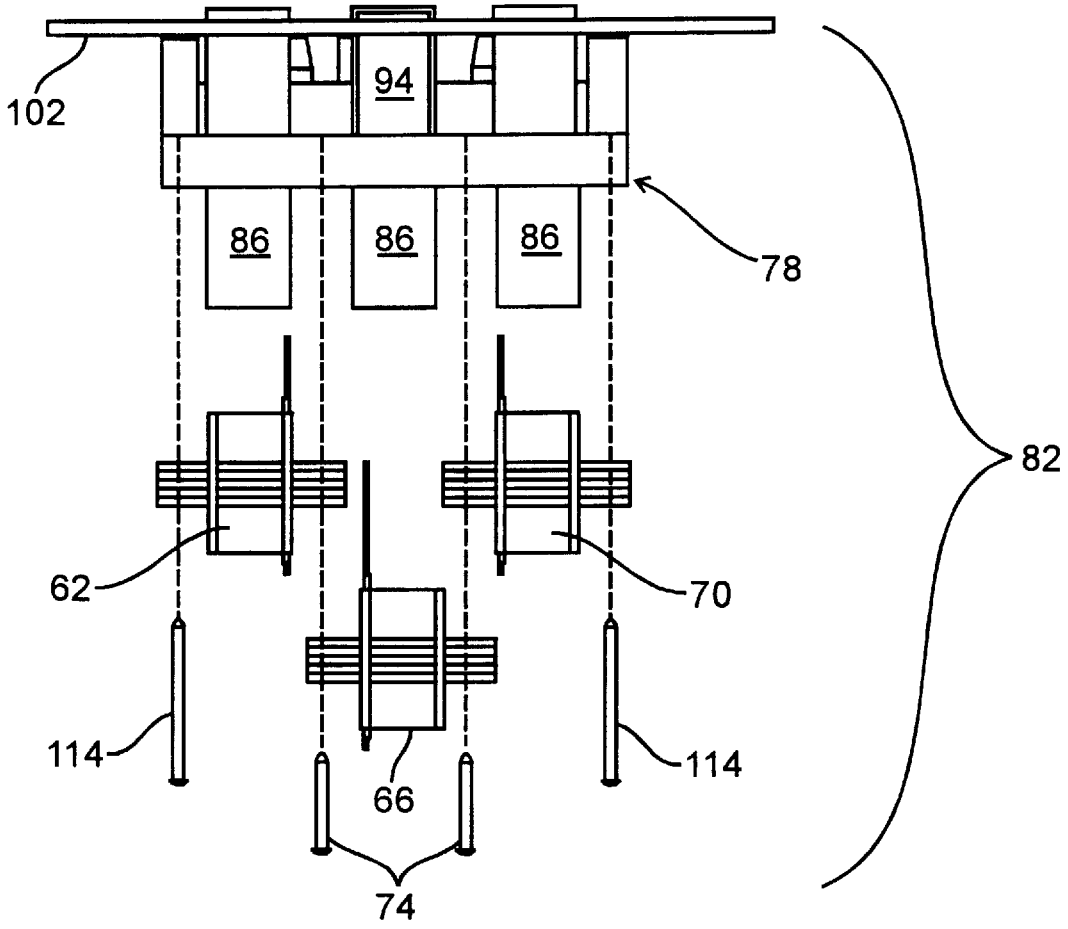
FIG. 9 is an exploded view of a three phase transformer assembly with transformer carrier in accordance with the present invention.

As shown in FIGS. 6 and 7, a three phase transformer can be made by taking three transformers 118, 122, and 126, each assembled in the same manner as transformer 10 described above, and placing them side-by-side such that the core legs 22 adjacent the bobbin 26 of the center transformer 66 overlap the inside core legs 22 of the two outside transformers 62 and 70. The overlapped legs 22 of the three transformer cores 14 are fixed together by mechanical fasteners such as rivets 130 or similar fasteners. In the preferred embodiment a molded transformer carrier 134, as shown in FIGS. 8 and 9, will form the base for a three phase transformer assembly 82. The transformer carrier 134 is preferably made from an electrically insulating material and defines three tubes 86 which will receive the electrical conductors of the primary circuit. The transformers 118, 122, and 126, are individually placed into the transformer carrier 134 such that the window 18 of each of the three adjacent transformers 118, 122, and 126 will receive one of the tubes 86. The transformer carrier also defines a number of stand-off sleeves 90, some of which will receive the printed circuit board terminals 58 as the transformers 118, 122, and 126 are placed into the transformer carrier 134. The overlapped core legs 22 of the transformers 118, 122, and 126 are simultaneously riveted together and to the transformer carrier 134 by the rivets 130 thus forming the preferred three phase transformer assembly 82. The transformer carrier 134 also includes a pair of integrally formed generally parallel retainers 94, each having an inwardly facing flange 98 at its distal end. The retainers 94, in cooperation with the stand-off sleeves 90 permit the transformer carrier 134 to be snappingly attached to a printed circuit board 102. The retainers 94 are received within a pair of holes 106 defined by the printed circuit board 102 such that the flanges 98 engage one side of the printed circuit board 102 as the distal ends of the stand-off sleeves 90 engage the other side, thereby captivating the board 102 between the flanges 98 and the stand-off sleeves 90. The printed circuit board 102 also defines holes 110 for receiving the tubes 86 as the transformer assembly 82 is snapped onto the printed circuit board 102. After snapping the transformer assembly 82 in place on the printed circuit board 102 longer rivets 114 are passed through the laminations of the two outside transformers 118 and 126, the stand-off sleeves 90 and the printed circuit board 102. As electrical components are wave soldered to the printed circuit board 102 the printed circuit board terminals 58 and rivets 114 are also soldered to the printed circuit board 102 thus fixing the transformer assembly 82 to the printed circuit board 102. It may also be desirable to place an adhesive between the transformer coils and the transformer carrier 134 for additional protection against vibration and shock.

We claim:

1. A method of assembling a three phase current transformer, comprising the steps of:

placing three current transformers, each having cores of unassembled continuous laminations and a coil wound around one leg of said unassembled continuous laminations such that adjacent legs of said cores are overlapping;

placing rivets simultaneously through holes defined in said overlapped core legs for fixing said cores together thereby forming said three phase current transformer.

2. A method of assembling a three phase printed circuit board mountable current transformer, comprising the steps of:

placing three current transformers, each having unassembled continuous lamination cores into a transformer carrier such that said cores are arranged side-by-side and core legs of said adjacent cores overlap;

placing rivets simultaneously through holes defined in said overlapped core legs and through holes in said transformer carrier for fixing said cores and said transformer carrier together forming said three phase transformer.

3. A method of assembling a three phase printed circuit board mountable current transformer, comprising the steps of:

assembling a first current transformer by placing a bobbin around a leg of an unassembled continuous lamination transformer core said bobbin having a first flange and a second flange being generally parallel to one another and spaced apart from one another by a generally tubular bobbin base, each said flange further including an outwardly facing surface in which a concentric groove is defined, said first flange further including a circumferential gear in said outwardly facing surface;

inserting two printed circuit board terminating pins into said second flange of said bobbin such that said pins are generally parallel to one another and extend an equal distance outward from opposites sides of said second flange;

placing the transformer core with said bobbin and said printed circuit board terminating pins installed thereon into a spin winding fixture;

placing a bobbin bearing having a circumferential ridge immediately adjacent said outwardly facing surfaces of each of said first and second flanges such that said circumferential ridges are partially received within said concentric grooves of said outwardly facing surfaces;

terminating a leading end of a coil wire on one of said printed circuit board terminating pins;

engaging said circumferential gear of said first flange with a drive gear for producing high speed rotation of said bobbin;

winding said coil wire uniformly about said bobbin base between said first and second flanges as said bobbin is rotated;

terminating a trailing end of said coil wire on the other of said printed circuit board terminating pins;

pressing said printed circuit board terminating pins further into said second flange until the desired length extends outwardly from the opposite side of said second flange;

soldering the terminated coil wire connections;

repeating the above steps for assembling a second and a third current transformer;

placing said first, second and third current transformers into a transformer carrier in side-by-side relationship such that two generally parallel legs of a center current transformer overlap adjacent legs of two outside current transformers and wherein said printed circuit board terminal pins are received in sleeves integrally formed from said transformer carrier;

placing rivets simultaneously through holes in said overlapping transformer legs and holes in said transformer carrier such that said current transformers and said transformer carrier are fixed together forming said three phase current transformer.

* * * * *